United States Patent [19]

Nystrom

[11] Patent Number: 4,685,889

[45] Date of Patent: Aug. 11, 1987

[54] PROPELLER DRIVEN TUNNEL BOAT

[76] Inventor: Norman A. Nystrom, 7165 Buchanan Ct., Mentor, Ohio 44060

[21] Appl. No.: 946,147

[22] Filed: Dec. 23, 1986

Related U.S. Application Data

[63] Continuation of Ser. No. 777,687, Sep. 19, 1985, abandoned.

[51] Int. Cl.[4] ..... B63H 5/16

[52] U.S. Cl. ..... 440/69

[58] Field of Search ..... 440/66, 68, 69, 70, 440/79; 114/288, 289, 290, 291, 271, 57

[56] References Cited

U.S. PATENT DOCUMENTS

| | | | |
|---|---|---|---|
| 1,007,583 | 10/1911 | Loetzer | 440/69 |
| 1,108,340 | 8/1914 | Criqui | 440/69 |
| 3,138,130 | 6/1964 | Morgan | 440/68 X |
| 3,626,894 | 12/1971 | Stuart | 440/69 |
| 3,744,446 | 7/1973 | Gibbons | 440/69 |
| 3,811,399 | 5/1974 | Kobayashi et al. | 440/69 |
| 4,300,889 | 11/1981 | Wormser | 440/69 |
| 4,609,360 | 9/1986 | Whitehead | 440/69 |

*Primary Examiner*—Joseph F. Peters, Jr.
*Assistant Examiner*—Paul E. Salmon
*Attorney, Agent, or Firm*—James A. Hudak

[57] ABSTRACT

A tunnel boat design that is not dependent upon turbulent or resurgent water flow is disclosed. A V-shaped portion of the tunnel and its adjacent rectangular-shaped tunnel portion "direct" water toward a funnel-shaped tunnel portion which "funnels" the water into a semi-circular tunnel portion surrounding the propeller. By obliquely positioning the V-shaped portion, the rectangular-shaped portion and the funnel-shaped portion of the tunnel at pre-determined angles with respect to the keel line of the boat, sufficient water is "lifted" upwardly within the tunnel and directed toward the propeller to propel the boat without causing turbulent or resurgent water flow and/or cavitation.

6 Claims, 7 Drawing Figures

PROPELLER DRIVEN TUNNEL BOAT

This is a continuation of co-pending application Ser. No. 777,687, filed on Sept. 19, 1985, now abandoned.

TECHNICAL FIELD

The present invention relates to a design for a propeller driven boat, and more particularly to a boat design having a tunnel provided in the hull thereof to direct water to the propeller driving the boat.

BACKGROUND ART

Numerous designs of propeller driven boats incorporating a tunnel in the boat hull have been developed. Such boats are typically categorized as shallow draft boats and the tunnels are utilized to direct the water toward the propeller driving the boat. Even though these designs provide water flow for the shallow draft design, in many instances they produce objectionable operating results. For example, in order for these prior art designs to provide sufficient water to the propeller, they create turbulent or resurgent water flow within the tunnel. Such turbulent or resurgent flow decreases the overall operating efficiency of the boat since it creates, in effect, a force which opposes the forward motion of the boat. It has also been found with these prior art designs that cavitation usually exists within the tunnel. Such cavitation can cause erosion of metallic objects, such as the propeller, which are exposed to same.

Because of the foregoing, it has become desirable to develop a tunnel design for a propeller driven boat wherein turbulent or resurgent water flow is negligible within the tunnel and wherein cavitation is minimized.

SUMMARY OF THE INVENTION

The present invention solves the aforementioned problems associated with the prior art as well as other problems by providing a tunnel boat design which is not dependent upon turbulent or resurgent water flow within the tunnel to provide sufficient water to the propeller and which minimizes cavitation and its detrimental effects. The foregoing is accomplished through a tunnel design comprising a V-shaped portion, a rectangular-shaped portion, a funnel-shaped portion, and a semi-circular portion in that order with the V-shaped portion being nearest the bow of the boat and the semi-circular portion being adjacent the stern of the boat. The V-shaped portion and the rectangular-shaped portion are positioned at a first predetermined angle with respect to the keel line of the boat so as to direct water into the tunnel structure and toward the propeller. The funnel-shaped portion is at a second pre-determined angle with respect to the keel line of the boat and transforms the rectangular-shaped portion of the tunnel into the semi-circular portion of the tunnel which surrounds the propeller and, in effect, "funnels" the water toward the propeller. This "funneling action" provides an adequate supply of water having minimal turbulence to the propeller without cavitation and also imparts a dynamic lift to the boat.

DESCRIPTION OF THE PREFERRED EMBODIMENT

Figure 1:
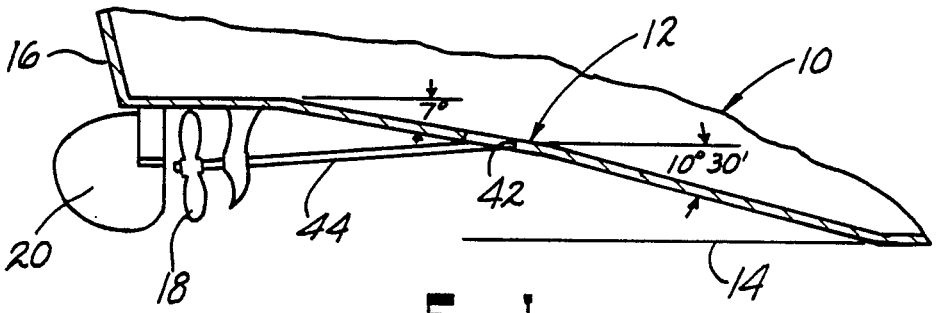
FIG. 1 is a side elevation view, partially broken away in cross-section, of a boat hull incorporating the tunnel design of the present invention.

Referring now to the drawings where the illustrations are for the purpose of describing the preferred embodiment of the present invention and are not intended to limit the invention hereto, FIG. 1 is a partial cross-sectional view of a boat hull 10 incorporating a tunnel 12 having a unique design. The tunnel 12 is symmetrical about the keel line 14 of the hull 10 and extends from the stern 16 towards the bow of the boat. A propeller 18 is located within the tunnel 12 inwardly of the stern 16, and a movable rudder 20 is positioned external to the tunnel 12 and adjacent the stern 16.

The tunnel 12 is typically formed from metallic sheet material, such as aluminum, and is comprised of a V-shaped portion 22, a rectangular-shaped portion 24, a funnel-shaped portion 26, and a semi-circular portion 28, all connected in the foregoing order so that the V-shaped portion 22 is nearest the bow of the boat and the semi-circular portion 28 is adjacent the stern 16 of the boat. The V-shaped portion 22 is substantially flat in cross-section and is actually a continuation or extension of the rectangular-shaped portion 24 (hereinafter described). This V-shaped portion 22 of the tunnel 12 is obliquely disposed upwardly at an angle of approximately 10° 30′ with respect to the keel line 14 of the boat. Because of this angular orientation, the height and width of this portion 22 of the tunnel 12 progressively increases in the direction of the stern of the boat. The angle included within the V-shape is dependent upon the shape of the bottom of the hull 10 and the planing angle or cruising angle of the boat. The V-shaped portion 22 starts or begins in a point 30 which is coincident with the keel line 14 of the boat. This portion 22 of the tunnel 12 is used to create an unobstructed entry for water flow into the tunnel structure and to direct the water into the rectangular-shaped portion 24 of the tunnel 12.

Figure 2:
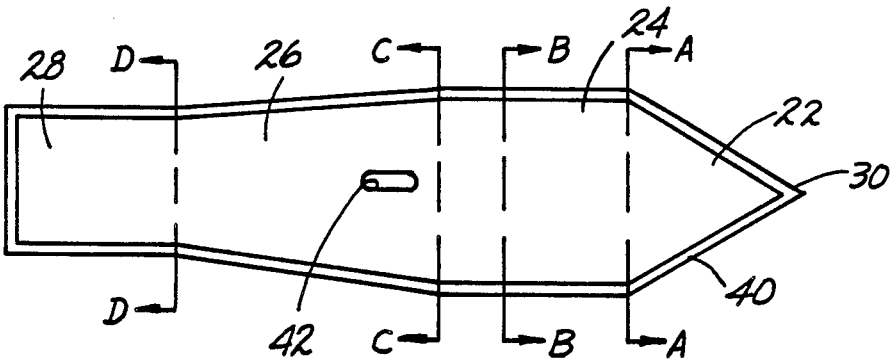
FIG. 2 is a top plan view of the tunnel portion of the boat hull shown in FIG. 1.

The V-shaped portion 22 of the tunnel 12 merges into the rectangular-shaped portion 24 of the tunnel at line A—A, as shown in FIG. 2. This portion 24 of the tunnel is substantially rectangular in cross-section and is similarly obliquely disposed upwardly at an angle of approximately 10° 30′ with respect to the keel line 14 of the boat. Because of this angular orientation, the height of this rectangular-shaped portion 24 of the tunnel 12 progressively increases in the direction of the stern of the boat. The width of this portion 24 of the tunnel remains substantially constant for its entire length. The result is that the surface defining this rectangular-shaped portion 24 of the tunnel 12 is of constant width and is inclined slightly with respect to the keel line 14 so as to direct water from its entry at its juncture with the V-shaped portion 22 into the funnel-shaped portion 26 of the tunnel 12.

The rectangular-shaped portion 24 of the tunnel 12 merges into the funnel-shaped portion 26 of the tunnel at line C—C. This portion 26 of the tunnel narrows inwardly toward the stern 16 of the boat, and is obliquely disposed upwardly at an angle of approximately 7° with respect to the keel line 14 of the boat. Because of the foregoing angular orientation, the height of this funnel-shaped portion 26 progressively increases in the direction of the stern of the boat. In essence, this portion 26 of the tunnel 12 gradually and smoothly transforms the rectangular-shaped portion 24 of the tunnel 12 into a configuration that is substantially semi-circular in configuration and "funnels" the water toward the propeller 18 in the semi-circular portion 28 of the tunnel 12. This "funneling" action lifts the water within the tunnel 12 which imparts a dynamic lift to the boat when travelling at higher rates of speed.

Figure 3:
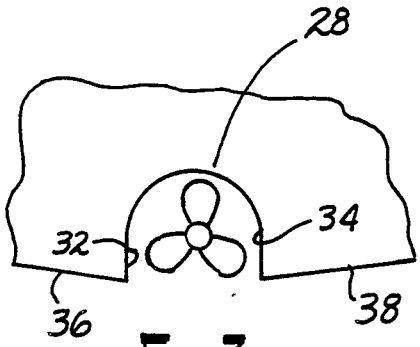
FIG. 3 is a rear view of a boat hull incorporating the tunnel design of the present invention, as viewed from the left of FIG. 1.
Figure 4:
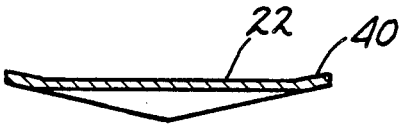
FIG. 4 is a cross-sectional view taken along section-indicating lines A—A of FIG. 2.
Figure 5:
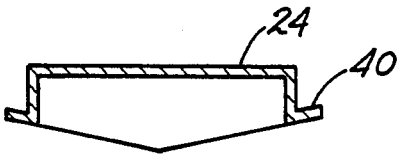
FIG. 5 is a cross-sectional view taken along section-indicating lines B—B of FIG. 2.
Figure 6:
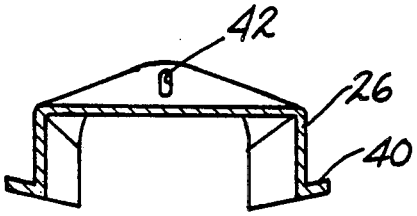
FIG. 6 is a cross-sectional view taken along section-indicating lines C—C of FIG. 2.
Figure 7:
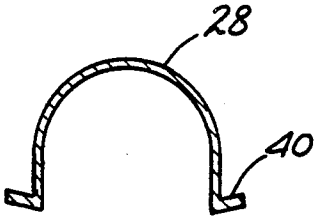
FIG. 7 is a cross-sectional view taken along section-indicating lines D—D of FIG. 2.

The funnel-shaped portion 26 of the tunnel 12 merges into the semi-circular portion 28 of the tunnel at line D—D. This portion 28 of the tunnel is substantially semi-circular in cross-section, as shown in FIG. 3, and the top of this semi-circular portion 28 is substantially parallel to the keel line 14 of the boat. The surface defining this semi-circular portion 28 terminates in side walls 32, 34 which intersect the port side 36 and the starboard side 38, respectively of the hull 10. It should be noted that height of the side walls 32, 34 is such that the propeller 18 is totally contained within the area defined by the cross-sectional configuration of the semi-circular portion 28 of the tunnel 12 and the bottom surfaces of the hull 10 as projected to the keel line 14 of the boat so as to control the radial flow of water off the propeller 18. It should be further noted that the semi-circular portion 28 of the tunnel 12 fits rather closely around the propeller 18 with a clearance of approximately one inch and extends aft of the propeller 18 for a short distance. Due to the foregoing configuration of this portion 28 of the tunnel 12 and the placement of the propeller 18 therein, the thrust created by the propeller 18 is used most effectively to propel the boat.

The outer edges defining the V-shaped portion 22, the rectangular-shaped portion 24, the funnel-shaped portion 26, and the semi-circular portion 28 of the tunnel 12 are bent upwardly forming a continuous flange-like surface 40 which conforms to the contour of the bottom of the hull 10 for fastening purposes. Typically, the tunnel 12 is attached to the hull 10 by rivets or other appropriate fastening means which pass through the flange-like surface 40 and the mating bottom of the hull 10. It should be noted, however, that if the hull 10 of the boat is formed or molded from a moldable material, such as fiberglass, the tunnel 10 can be molded directly therein thus making the foregoing fastening process unnecessary.

Regardless of whether the tunnel is fabricated and subsequently attached to the hull 10 of the boat or integrally molded into the hull, an elongated slot 42 is provided in the funnel-shaped portion 26 of the tunnel 12 to receive the drive shaft 44 for the propeller 18. The location of the slot 42 and its size depends upon the angular inclination of the drive shaft 44 with respect to the hull 10 of the boat and the diameter of the drive shaft.

The overall length of the tunnel 12 is dependent upon the hull's planing angle (for light boats) or its cruising angle (for heavier boats) and the height of the semi-circular portion 28 of the tunnel 12 is dependent upon the size of the propeller 18 and the power source for the boat. The objective in determining the optimum length of the tunnel is to have the top surface of the rectangular-shaped portion 24 and the V-shaped portion 22 of the tunnel 12 substantially parallel to the surface of the surrounding water in the direction of travel of the boat when the boat is operating at nominal design speed. Such parallelism is readily achievable with this tunnel design and results in the elimination of resurgent water flow in the tunnel which is very prevalent in other tunnel designs. The condition that creates such resurgent water flow also creates a significant force opposing the forward motion of the boat.

When the boat is operating at less than nominal design speed, the propeller 18 may be only partially submerged in the water. Under this operating condition, other tunnel drive boat designs supply water to the propeller through turbulent resurgent flow in the forward portion of the tunnel. The foregoing design of the present invention virtually eliminates such turbulent resurgent flow inasmuch as the design causes the water to be "funneled" toward the longitudinal center of the hull and lifted upwardly toward the stern 16 providing the propeller 18 with an adequate volume of water for propulsion purposes. As the forward motion of the boat increases, the foregoing "funnel effect" of this design continues to operate in the same manner thus minimizing any loss of efficiency through turbulence and/or cavitation. As the speed of the boat continues to increase, dynamic lift also increases further improving the efficiency of the boat incorporating this tunnel design.

Certain modifications and improvements will occur to those skilled in the art upon reading the foregoing. It should be understood that all such modifications and improvements have been deleted herein for the sake of conciseness and readability, but are properly within the scope of the following claims.

I claim:

1. A boat hull having a longitudinally extending tunnel formed on the underside thereof, said tunnel comprising a section of increasing transverse width in the direction of the stern of the boat, a section of decreasing transverse width in the direction of the stern of the boat, said decreasing transverse width section having oppositely disposed substantially parallel sides, a first section of substantially constant transverse width disposed between and interconnecting said increasing transverse width section and said decreasing transverse width section, said first substantially constant transverse width section being substantially rectangular in cross-section, said increasing transverse width section and said first substantially constant transverse width section each having a substantially flat surface thereon, the combination of said substantially flat surfaces defining a first plane obliquely disposed at a first pre-determined angle with respect to the keel line of the boat, and a second section of substantially constant transverse width connected to said decreasing transverse width section so as to be oppositely disposed from said first substantially constant transverse width section, said second substantially constant transverse width section being substantially semi-circular in cross-section and having a top surface substantially parallel to the keel line of the boat, said decreasing transverse width section transforming the surface defining said substantially rectangular cross-section of said first substantially constant transverse width section into the surface defining said substantially semi-circular cross-section of said second substantially constant transverse width section.

2. The boat hull as defined in claim 1 wherein the longitudinal axis of said tunnel is coincident with the keel line of the boat.

3. The boat hull as defined in claim 1 wherein said increasing transverse width section of said tunnel is adjacent the bow of the boat.

4. The boat hull as defined in claim 1 wherein said second substantially constant width section of said tunnel is adjacent the stern of the boat.

5. The boat hull as defined in claim 1 wherein the magnitude of said first pre-determined angle of said first plane is such that said first plane defining surfaces of said increasing transverse width section and said first substantially constant transverse width section of said tunnel are substantially parallel to the surface of the water surrounding the boat when the boat is travelling at nominal design speed.

6. The boat hull as defined in claim 1 wherein said decreasing transverse width section of said tunnel includes a surface defining a second plane obliquely disposed at a second pre-determined angle with respect to the keel line of the boat.

* * * * *